US006098317A

United States Patent [19]

Lazzaroni

[11] Patent Number: 6,098,317

[45] Date of Patent: Aug. 8, 2000

[54] BOOT INTENDED FOR CROSS-COUNTRY SKIING

[75] Inventor: Robert Lazzaroni, La Buisse, France

[73] Assignee: Skis Rossignol S.A., France

[21] Appl. No.: 09/195,899

[22] Filed: Nov. 19, 1998

[30] Foreign Application Priority Data

Nov. 24, 1997 [FR] France ..... 97 14955

[51] Int. Cl.[7] ..... H43B 5/00

[52] U.S. Cl. ..... 36/118.2; 36/101; 36/117.2; 36/115; 36/118.7

[58] Field of Search ..... 36/117.2, 118.2, 36/115, 101, 100, 118.3, 118.4, 118.7, 118.8

[56] References Cited

U.S. PATENT DOCUMENTS

| | | | |
|---|---|---|---|
| 3,844,055 | 10/1974 | Koyama et al. | 36/118.2 |
| 5,329,707 | 7/1994 | Chaigne et al. | 36/118.2 |

FOREIGN PATENT DOCUMENTS

| | | | |
|---|---|---|---|
| 268933 | 2/1969 | Austria | 36/118.2 |
| 0 484 683 A1 | 5/1992 | European Pat. Off. . | |
| 0 486 801 A1 | 5/1992 | European Pat. Off. . | |
| 2666201 | 3/1992 | France | 36/117.2 |
| 2839418 | 4/1979 | Germany | 36/118.2 |
| 295 18 019 | 1/1996 | Germany . | |
| 391509 | 9/1965 | Switzerland | 36/118.2 |
| 91/07889 | 6/1991 | WIPO . | |

*Primary Examiner*—M. D. Patterson
*Attorney, Agent, or Firm*—Wall Marjama Bilinski & Burr

[57] ABSTRACT

A boot is intended for cross-country skiing, ice skating or roller skating, the boot including an upper that includes stiffeners. The boot has a cuff mounted on the upper so that the cuff can articulate forward and rearward. The boot includes two rivets having pins. The rivets are mounted on the stiffeners at a level with the malleoli of the wearer. There are included circular recesses in the cuff with the recesses facing the malleoli and the pins pass through the recesses. There is an arcuate groove located either on the outer surface of the upper or the inner surface of the cuff. There is an arcuate rib located on the cuff or upper opposite of the groove. The rib and the groove have the same radius centered on the pin whereby the rib moves freely in the groove.

9 Claims, 3 Drawing Sheets

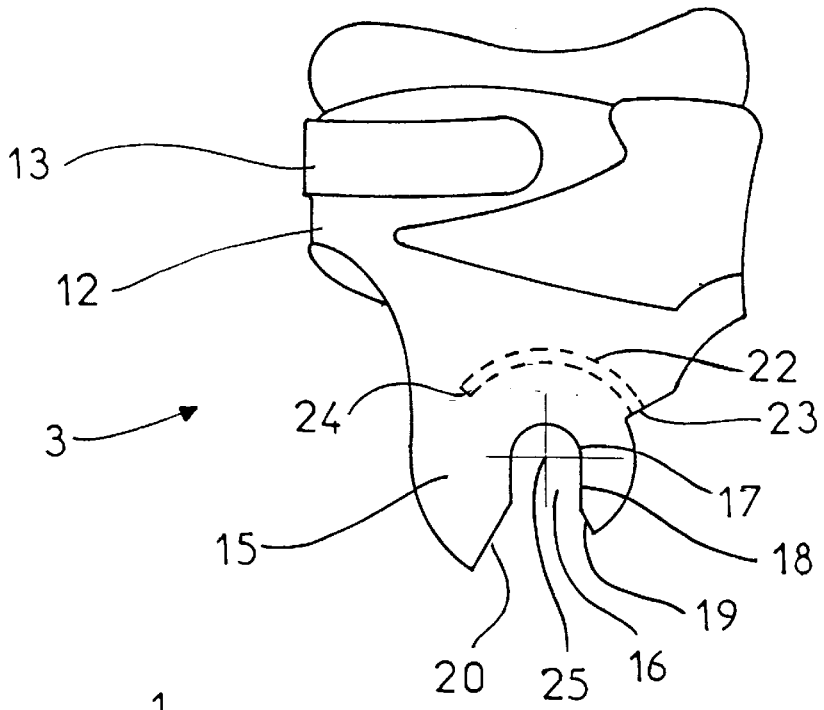
FIG 1
1
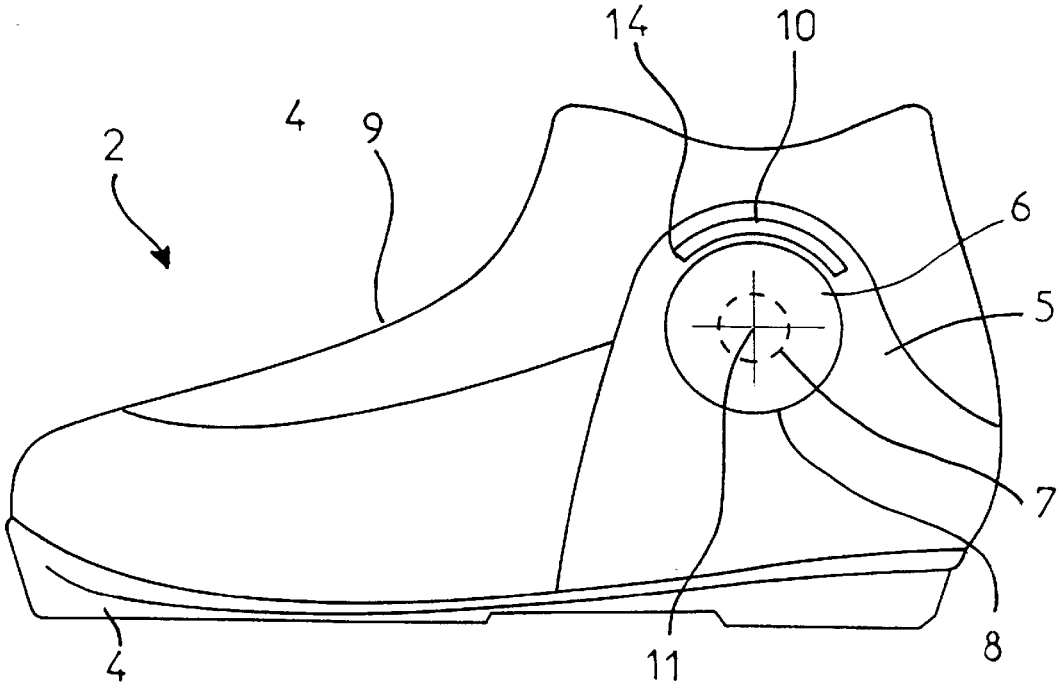

BOOT INTENDED FOR CROSS-COUNTRY SKIING

TECHNICAL FIELD

The invention relates to the field of gliding sports. It more precisely concerns a boot intended for cross-country skiing or ice skating or roller skating. In the rest of the description, the invention is described more particularly in its application in the field of cross-country skiing, but adaptation to the field of skating presents no particular problem to the person skilled in the art.

It more precisely concerns cross-country ski boots which have a cuff enclosing the lower leg. Its object is a particular arrangement making it possible to extract this collar with ease, and also fit it without difficulty whenever the user wishes to ski cross-country using the classical technique or using the skating technique.

PRIOR ART

As is known, it is possible to ski cross-country using two quite different methods, on the one hand the classical technique in which the skis stay parallel and the heels are lifted alternately perpendicular to the ski. This technique is more popular with novice skiers or with recreational skiers.

Further to this, there is also a "skating" technique in which the skier moves by pressing laterally on his skis, which are at a large angle to the main direction of motion. This is more of a sporting technique and generally requires more effort from the skier.

It is easy to see that the forces exerted on the ski, and on the boots, differ from one technique to the other. In the classical technique, the boots are essentially stressed where they attach to the ski at the bindings, and low boots are therefore used. Conversely, when using the skating technique, the binding zone is also stressed but it is essential for the lower leg to be held properly, in view of the transverse direction of the forces exerted by the skier. This is why, in this type of boot, the upper is extended at the top by a relatively rigid cuff which encloses the lower leg.

However, intermediate skiers may find both techniques attractive. This is why it proves advantageous for boots which can be used for the skating technique to be convertible to more comfortable boots specifically designed for the classical technique.

A first problem which the invention proposes to solve is that of easily converting a skating technique boot into a classical technique boot, and vice versa.

One solution to this problem has been presented in Patent FR 2 726 976 in the name of the Applicant, which describes a cross-country ski boot having an upper with a lateral stiffener on which a rigid cuff is mounted. The stiffener of the upper has a pin intended to interact with the lower side part of the cuff in order to let it articulate forward and rearward. In order to hold the cuff in position, and at the same time to limit the amplitude for which the cuff moves relative to the upper, the upper is equipped with a protruding stud located below the rotation axis of the cuff. This stud passes through a slot formed for this purpose in the lower part of the cuff. This protruding stud has a button which holds the cuff pressed against the upper. However, in order for the cuff to be fitted, the hole and the slot through which the pin and the stud respectively pass have particular shapes.

In practice, the hole and the slot are extended by an opening which is offset in order to make it possible to insert the pin and the stud. In practice, it is necessary to present the cuff in a very specific orientation and in the only position which can permit simultaneous insertion of the pin and the stud. An operation of this type proves difficult for the user. Because of this, the user tends not to remove the cuff for engaging in the classical technique. In other words, in order to fit and remove a cuff of this type, it is necessary to combine two positioning and shifting operations which are impractical. It can therefore be seen that easy fitting of the cuff is incompatible with proper positioning and tight holding of the cuff under pressure.

A second problem which the invention therefore proposes to solve is that of ergonomics and convenience when fitting the cuff and for this to be compatible with effective holding of the cuff and arrangements facilitating the articulation of the cuff relative to the upper.

BRIEF DESCRIPTION OF THE INVENTION

The invention therefore relates to a boot intended for cross-country skiing of the type having a cuff mounted articulated on an upper to allow the leg to move forward and rearward, the articulation being provided by the interaction:

of rivets mounted on the upper level with the malleoli;

and circular recesses which are formed in the cuff facing the malleoli and through which the pins of said rivets pass.

Such a boot is one wherein in the upper/cuff combination, one comprises a groove and the other comprises a rib, these being arranged facing one another on the outer face of the upper and the inner face of the cuff, said grooves and ribs forming two arcs of a circle with the same radius which are centered on the center of the pin of the rivet, so that when the cuff is fitted on the pin of the rivet, the rib moves freely in the groove.

In other words, the cuff and the upper have complementary shapes which mutually engage to serve as a guide for the articulation and inclination of the cuff. The cuff is fitted, and the complementary shapes consisting of the groove and the rib are interlocked, simply by inserting the pin of the rivet into the circular recess in the cuff.

It is thus possible for the rib and the groove to be located equally well on the cuff and on the upper, or vice versa.

In the case when the rib is located on the cuff, that end of the groove which is directed toward the rear terminates at the rear of the upper so as to make it possible to insert the rib into the groove by tilting the cuff rearward.

Conversely, when the rib is located in the upper, that end of the groove which is directed toward the rear terminates at the rear of the cuff so as to make it possible to insert the rib into the groove by tilting the cuff forward.

In this way, when the cuff is fed over the pin of the rivet, no precise positioning movement is necessary other than tilting the cuff into its working position.

In another embodiment, the groove has two closed ends, so that the rib is inserted into the groove by deforming the cuff and/or the stiffener, during the movement for fitting the pin of the rivet in the circular recess in the cuff.

In order to make it easier to fit the cuff on the pin mounted level with the malleoli, the circular recesses with which the cuff is pierced terminate at the bottom in an opening whose size is greater than or equal to the diameter of the pin of the rivet. In this way, no deformation of this zone of the cuff is needed for fitting the cuff on the pin of the rivet on the upper.

The recess for the pin of the rivet is thus not subjected to any mechanical stress, which limits wear and the risk of breaking.

Advantageously, in practice, the circular recess has a shape composed of a semicircular portion connected to a portion which has two parallel edges and is continued by a flared zone, making the insertion easier.

Advantageously, in practice, the groove has at least one end against which the rib abuts when the cuff is in the rearmost position.

In another embodiment, the rib has an increased thickness at one of its ends in order to interact with the end of the groove so as to serve as a stop when the cuff is in the rearmost position.

BRIEF DESCRIPTION OF THE FIGURES

The way in which the invention is embodied and the advantages which result therefrom will emerge clearly from the description of the following embodiments, supported by the appended figures, in which:

FIG. 1 is a side view of a boot according to the invention, in which the cuff and the upper are separated.

EMBODIMENT OF THE INVENTION

Figure 2:
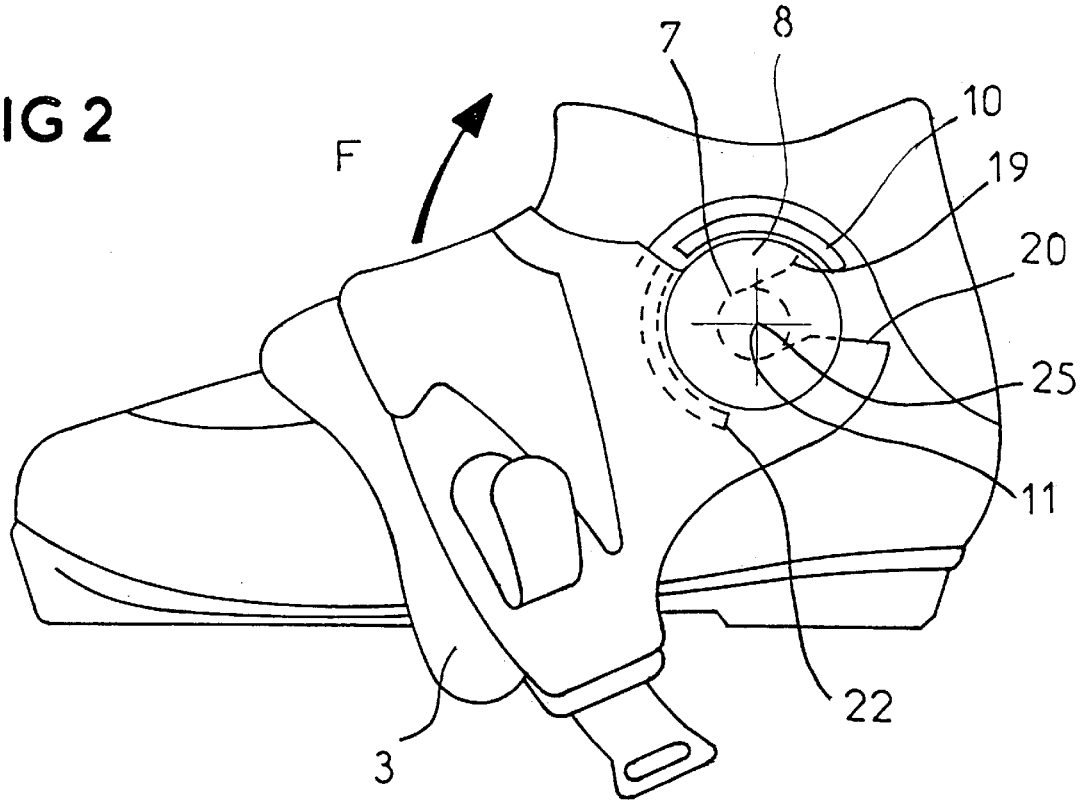
FIG. 2 is a side view of the boot of FIG. 1, in which the cuff is being fitted on the upper.

As can be seen in FIG. 1, a cross-country ski boot (1) consists of an upper (2) with which a cuff (3) may be associated. For cross-country skiing using the classical technique, only the upper (2) is needed, while when the skier wishes to use the skating technique, it is necessary for the cuff (3) to be fitted on the upper (2) in order to provide lateral support for his lower leg.

In known fashion, the upper (2) has a sole (4) with arrangements intended to interact with the binding (these are not shown). This boot (2) also comprises, on the top, a lacing zone or equivalent means allowing the foot to be held tight.

Laterally, the boot comprises a stiffener (5) which originates level with the sole and rises until it is level with the malleoli, enclosing them. Clearly, this stiffener is symmetrical and is also present on the side of the boot which is not shown in FIG. 1. Level with the malleoli, the stiffener has a rivet (6) consisting of a pin (7) which supports a button (8) on the outside. The diameter of this button (8) is much greater than that of the pin (7), typically of the order of two to three centimeters, while the diameter of the pin (7) is of the order of one centimeter.

In the variant illustrated in FIG. 1, the stiffener (5) has a rib (10), forming an arc of a circle, above the rivet (6). The arc of a circle formed by the rib (10), has its center (11) level with the center of the pin (7) of the rivet (6). This rib substantially describes a quarter of a circle, the top of which lies vertically in line with the malleolus.

The thickness of this rib is of the order of a few millimeters. This rib is advantageously produced directly when the stiffener is being molded.

Above the upper (2), the cuff (3) has, in the known way, a top part (12) which is intended to enclose the lower leg and has, for example, a tightening strap (13). The bottom part (15) of the cuff, which extends in the direction of the malleolus, comprises a recess (16) intended to receive the pin (7) of the rivet (6).

In the form which is represented, the recess (16) has, in its top part, a semicircular portion (17) which extends downward in a portion (18) having two parallel edges, this portion (17) ending in a flared zone having two diverging edges (19, 20).

In this way, this particular shape of the recess (16) fulfils a guiding function for fitting the cuff.

According to the invention, the cuff (3), and more precisely its bottom part (15), has a groove (22) hollowed in the thickness of the inner face. This groove (22) assumes the shape of an arc of a circle whose center (25) coincides with the center of the circular portion (17) of the recess (16). This center (25) is intended to coincide with the center (11) of the pin (7) of the rivet (6) of the upper (2). In other words, the radius of the groove (22) is equal to the radius of the rib (10).

In the embodiment illustrated in FIG. 1, the groove (22) of the cuff is hollowed in the thickness of the inner face of the cuff and has a rear end (23) which terminates at the rear of the cuff, while the front end (24) forms an angular zone with the inner face of the cuff.

Figure 3:
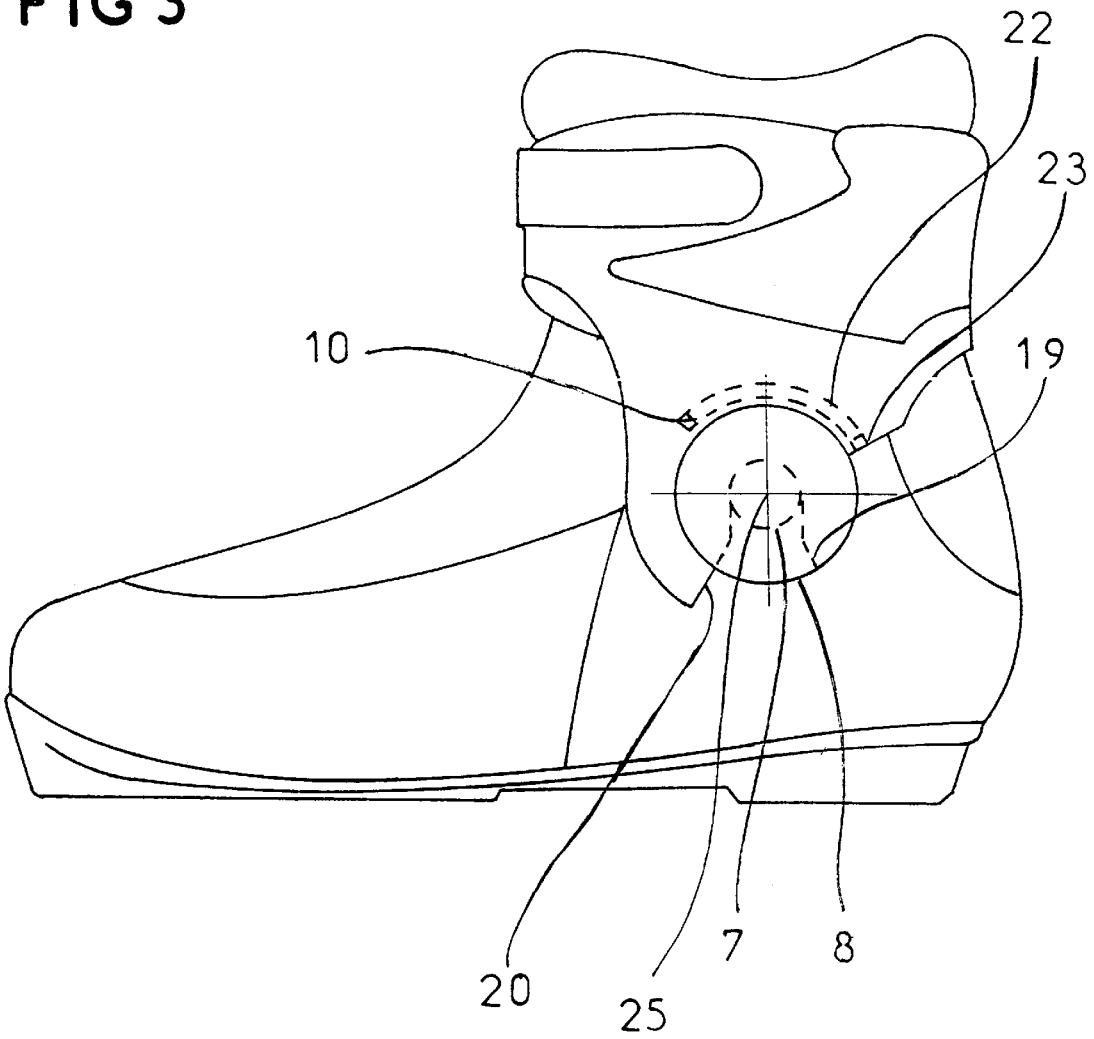
FIG. 3 is a side view of the boot of FIGS. 1 and 2, in which the cuff has been fitted on the upper.

When the cuff is being fitted on the upper, as illustrated in FIG. 2, the cuff is placed on the top (9) of the upper after having been untightened and opened. By a rearward translational movement, the recess (16) is moved in such a way that the portion (15) of the cuff (3) passes under the button (8) of the rivet (6). More exactly, the recess (16) is shifted in such a way that the pin (7) of the rivet (6) penetrates inside the recess (16). The sides (19, 20) of the flared zone of the recess (16) make this fitting procedure easier, without meticulous positioning having to be carried out. When the pin (7) reaches the end of the recess (16), in contact with the semicircular zone (17), the centers (25) and (11) of the rib (10) and of the groove (22) coincide. In this way, by a rearward pivoting motion illustrated by the arrow "F", the rib (10) and, more precisely, its front end (14), penetrates inside the rear end (23) of the groove (22). The movement can be continued until the cuff (3) reaches the normal vertical working position. Thus, the rib (10) slides inside the groove (22) freely. The result is illustrated in FIG. 3.

As can be seen in this figure, the large diameter of the button (8) ensures that the cuff (3), and more precisely its bottom zone (15), is pressed effectively against the stiffener (5). This pressure is needed to ensure that the rib (10) engages properly in the groove (22) and avoids accidental detachment of the cuff. The ratio between the radius of the button (8) and the radius of the arc of a circle forming the rib (10) is chosen in order to ensure optimum pressure.

The interaction between the rib (10) and the groove (22) also serves as a limiter for the rearward tilting of the cuff. Thus, the cuff (3) can pivot in such a way that the rib (10) slides inside the groove (22) until the front end (14) of the rib (10) comes into contact with the front end (24) of the groove (22). This corresponds to the rearmost position allowed for the cuff. Through its arrangement, excessive rearward tilting of the leg is avoided.

In another embodiment (not shown), the rib (10) has an increased thickness level with its rear end, in order to interact with the rear end (23) of the groove and serve as a stop when the cuff is in the rearmost position.

Quite clearly, the invention is not limited to the embodiments which have been illustrated, but covers variants in which the relative positions of the rib and the groove are reversed, that is to say the rib is on the stiffener (5) of the upper while the cuff has a projecting zone forming a rib.

In this case, it may prove advantageous, in order to make the insertion easier, for the groove to be present on the upper and to terminate at the front of the stiffener in order to make it easier to insert the rib on the cuff. It can therefore be seen that, in this case, the cuff is inserted from the rear in a movement which is similar to but the reverse of the one illustrated in FIG. 2.

In an alternative embodiment (not shown), the groove (22) illustrated in FIG. 1 does not terminate at the rear of the cuff, but has two ends hollowed into the inner face of the upper.

Figure 4:
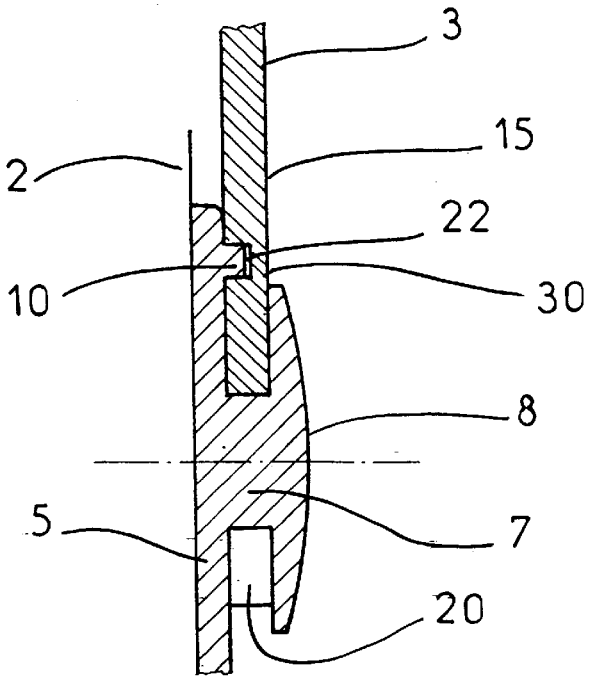
FIG. 4 is a view in section of the zone where the cuff attaches to the upper.

In this case, the cuff is fitted on the pin (7) of the rivet simultaneously with the insertion of the rib into the groove, by deformation of the zone (30) located between the outside of the button (8) and the groove (22) (see FIG. 4), and if appropriate as well as the zone of the stiffener which supports the rivet (6).

In this case, it proves particularly important to determine the relative positioning of the diameter of the button, and that of the arc of a circle forming the rib, in order to obtain a good compromise between the deformation strains which the bottom part of the cuff can withstand, and proper pressing of the cuff on the stiffener, ensuring proper interaction and interpenetration of the rib and the groove.

The above description shows that the boot according to the invention has arrangements which make it easier to fit the cuff on the upper with minimal manoeuvering.

Further, these particular arrangements guide the pivoting and provide a stop effect and on effect of limiting the rearward tilting of the cuff.

I claim:

1. A boot intended for cross-country skiing, ice skating or roller skating, the boot comprising:

an upper including stiffeners;

a cuff mounted on said upper wherein said cuff articulates forward and rearward, at least two rivets having pins, said rivets mounted on said stiffeners, said rivets mounted level with the malleoli of the user;

circular recesses formed in said cuff, said recesses facing the malleoli, said pins passing through said recesses;

an arcuate groove located on an outer surface of said upper;

an arcuate rib located on an inner surface of said cuff; wherein said groove and said rib have the same radius centered on said pin whereby said rib moves freely in said groove, wherein an end of said groove directed toward a rear of the boot terminates at a rear portion of the upper so as to make it possible to insert the rib into the groove by tilting the cuff rearward.

2. The boot of claim 1 wherein said circular recesses terminate at the bottom in an opening, said opening having a greater than or equal to diameter of said pin.

3. The boot of claim 2 wherein said circular recesses are partially defined by a semicircular portion connected to a portion which has two parallel edges and is continued by a flared zone.

4. The boot of claim 1 wherein said rib has an increased thickness at an end, said rib end interacting with an end of said groove whereby said rib end acts as a stop when said cuff is in a rearmost position.

5. A boot intended for cross-country skiing, ice skating or roller skating, the boot comprising:

an upper including stiffeners;

a cuff mounted on said upper wherein said cuff articulates forward and rearward, at least two rivets having pins, said rivets mounted on said stiffeners, said rivets mounted level with the malleoli of the user;

circular recesses formed in said cuff, said recesses facing the malleoli, said pins passing through said recesses;

an arcuate rib located on an outer surface of said upper;

an arcuate groove located on an inner surface of said cuff; wherein said groove and said rib have the same radius centered on said pin whereby said rib moves freely in said groove, wherein an end of said groove directed toward a rear of the boot terminates at a rear portion of the upper so as to make it possible to insert the rib into the groove by tilting the cuff rearward.

6. The boot of claim 5 wherein said circular recesses terminate at the bottom in an opening, said opening having a greater than or equal to diameter of said pin.

7. The boot of claim 6 wherein said circular recesses are partially defined by a semicircular portion connected to a portion which has two parallel edges and is continued by a flared zone.

8. The boot of claim 5 wherein said groove has a least one end against which said rib abuts when said cuff is in a rearmost position.

9. The boot of claim 5 wherein said rib has an increased thickness at an end, said rib end interacting with an end of said groove whereby said rib end acts as a stop when said cuff is in a rearmost position.

* * * * *